US008317936B2

(12) United States Patent
Woo

(10) Patent No.: US 8,317,936 B2
(45) Date of Patent: Nov. 27, 2012

(54) STEAM DISH WASHER

(75) Inventor: Sang Woo Woo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 777 days.

(21) Appl. No.: 12/232,622

(22) Filed: Sep. 19, 2008

(65) Prior Publication Data

US 2009/0126768 A1 May 21, 2009

(30) Foreign Application Priority Data

Sep. 21, 2007 (KR) ..... 10-2007-0096711

(51) Int. Cl.
*B08B 9/20* (2006.01)
*B08B 3/00* (2006.01)
*B08B 3/04* (2006.01)

(52) U.S. Cl. ..... 134/56 D; 134/25.2; 134/57 D; 134/58 D; 134/104.2

(58) Field of Classification Search ..... 134/25.2, 134/104.2, 56 D, 57 D, 58 D
See application file for complete search history.

(56) References Cited

U.S. PATENT DOCUMENTS 2,618,281 A * 11/1952 Ornas ..... 134/57 D
4,135,531 A 1/1979 Federighi et al.
4,235,642 A 11/1980 Federighi et al.
2004/0040586 A1 3/2004 Kumar
2007/0131261 A1* 6/2007 Lee et al. ..... 134/112

FOREIGN PATENT DOCUMENTS

| | | | |
|---|---|---|---|
| CN | 1931080 | | 3/2007 |
| DE | 10 2004 048 091 | A1 | 4/2006 |
| DE | 102004048091 | A1 * | 4/2006 |
| EP | 1759623 | | 3/2007 |
| EP | 1 790 269 | | 5/2007 |
| EP | 1 800 589 | A2 | 6/2007 |
| JP | 2-82930 | | 3/1990 |
| KR | 20-0288382 | | 9/2002 |
| WO | WO 97/20493 | | 6/1997 |

OTHER PUBLICATIONS

DE 10-2004-048091 English Translation Apr. 2006 Germany Scheringer et al.*

* cited by examiner

*Primary Examiner* — Michael Barr
*Assistant Examiner* — Charles W Kling
(74) *Attorney, Agent, or Firm* — McKenna Long & Aldridge LLP

(57) ABSTRACT

A dish washer which includes a steam generator. The dish washer, for example, may comprise a tub to provide a room for dishes for washing, a sump to hold water for supplying to the tub for the washing; a steam generator to generate steam, a first tube (or a steam tube) to provide a passage for the steam from the steam generator to the tub, and a valve to release the steam or water from the steam generator according to a pressure.

5 Claims, 4 Drawing Sheets

STEAM DISH WASHER

This application claims the benefit of Korean Patent Application No. 10-2007-0096711, filed on Sep. 21, 2007 which is hereby incorporated by reference in its entirety as if fully set forth herein.

BACKGROUND OF THE INVENTION

1. Field of the Invention

The present invention is related to a dish washer which includes a steam generator.

2. Discussion of the Related Art

Generally, dish washers are used for removing dirty and remaining food from food dishes and eating utensils (hereinafter, collectively referred to as dishes) by injecting wash water onto the dishes at a high pressure.

Such a dish washer includes a tub forming a cleaning chamber and a sump disposed at a lower portion of the tub for storing wash water. A pump is installed in the sump to pump the wash water to an injection nozzle connected to the sump. The wash water arrived at the injection nozzle is injected through a nozzle hole formed in an end of the injection nozzle at a high pressure. Two injection nozzles can be disposed at upper and lower portions of the tub, respectively, and the upper injection nozzle can be connected to the sump by a water guide.

SUMMARY OF THE INVENTION

A dish washer according to the present invention washes dishes using water and steam.

One embodiment of a dish washer according to the present invention may comprise, a tub to provide a room for dishes for washing, a sump to hold water for supplying to the tub for the washing, a steam generator to generate steam, and a first tube (or a steam tube) to provide a passage for the steam from the steam generator to the tub.

The dish washer may include a valve to release the steam or water out of the steam generator when the first tube is blocked.

The valve may operate according to a pressure. For instance, the valve may operate to open when an internal pressure of the steam generator or the first tube reaches a predetermined pressure.

Instead of the valve, a membrane may be used. The membrane may be broken at a predetermined pressure to allow the steam or the water inside of the steam generator to be discharged.

The dish washer may comprise a second tube (or a auxiliary steam tube) to provide a passage for the steam or the water to be released out.

The second tube may be configured to release the steam or the water to an inside of the tub.

The dish washer may further comprise an air guide to allow outside air to flow into the tub and the second tube may be configured to release the steam or the water through the air guide.

The second tube may be further configured to release the steam or the water to the inside of the tube through the sump.

Alternatively, the second tube may be configured to release the steam or the water to an outside of the dish washer, rather than the inside of the tub.

The second tube may be connected to a lower portion of the steam generator. Further, the second tube may be connected to a portion lower than a water level sensor of the steam generator.

The second tube may be connected to the steam generator at a portion lower than where the first tube is connected.

The dish washer may comprise a sensor to sense that the first tube is blocked and a controller to control the valve according the sensed result.

The sensor may include a pressure sensor and the controller may control the valve to open at a predetermined pressure.

Another embodiment of a dish washer according to the present invention may comprise a tub to provide a room for dishes for washing, a sump to hold water for supplying to the tub for the washing, a steam generator to generate steam, a first tube to provide a passage for the steam from the steam generator to the tub, a sensor to sense that the first tub is blocked, and a controller to control the steam generator according the sensed result.

The sensor may include a pressure sensor and the controller may switch off the steam generator at a predetermined pressure.

The controller may switch off a heater of the steam generator upon sensing that the first tub is blocked.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
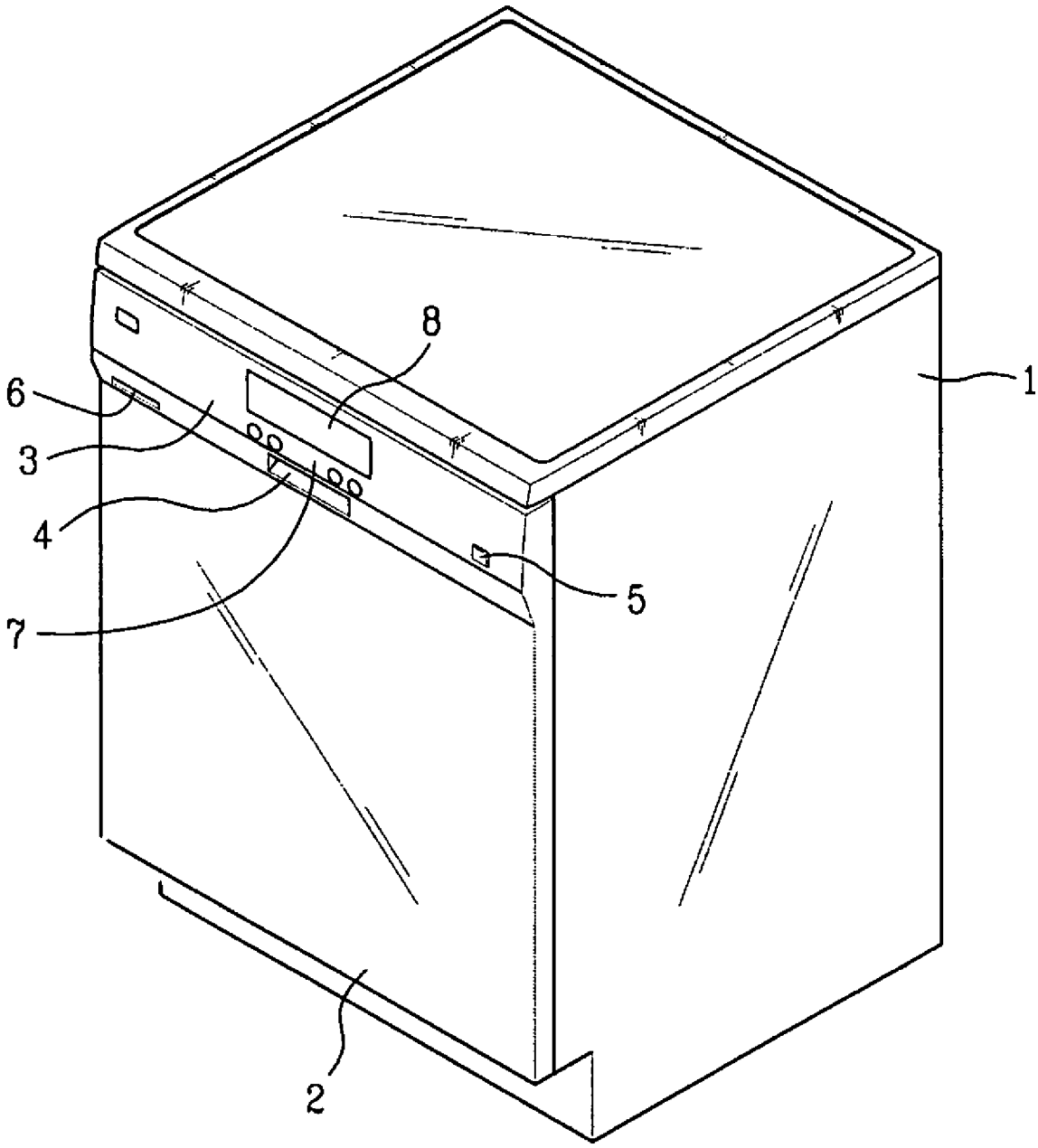
FIG. 1 shows a first embodiment of a dish washer according to the present invention.

Referring to FIG. 1, a dish washer includes a case 1 forming the external appearance of the dish washer, the case 1 being opened at the front thereof, a door 2 for opening and closing the open front of the case 1, and a control panel 3 provided at the upper side of the door 2 for displaying and controlling the operation of the dish washer.

The control panel 3 includes a power switch 5 for turning on/off the dish washer, a door grip 4 used for a user to open and close the door 2, an input device 7 for allowing the user to input various commands, a display device 8 for displaying the operation state of the dish washer, and a steam discharge port 6 for discharging high-temperature air out of the dish washer.

Figure 2:
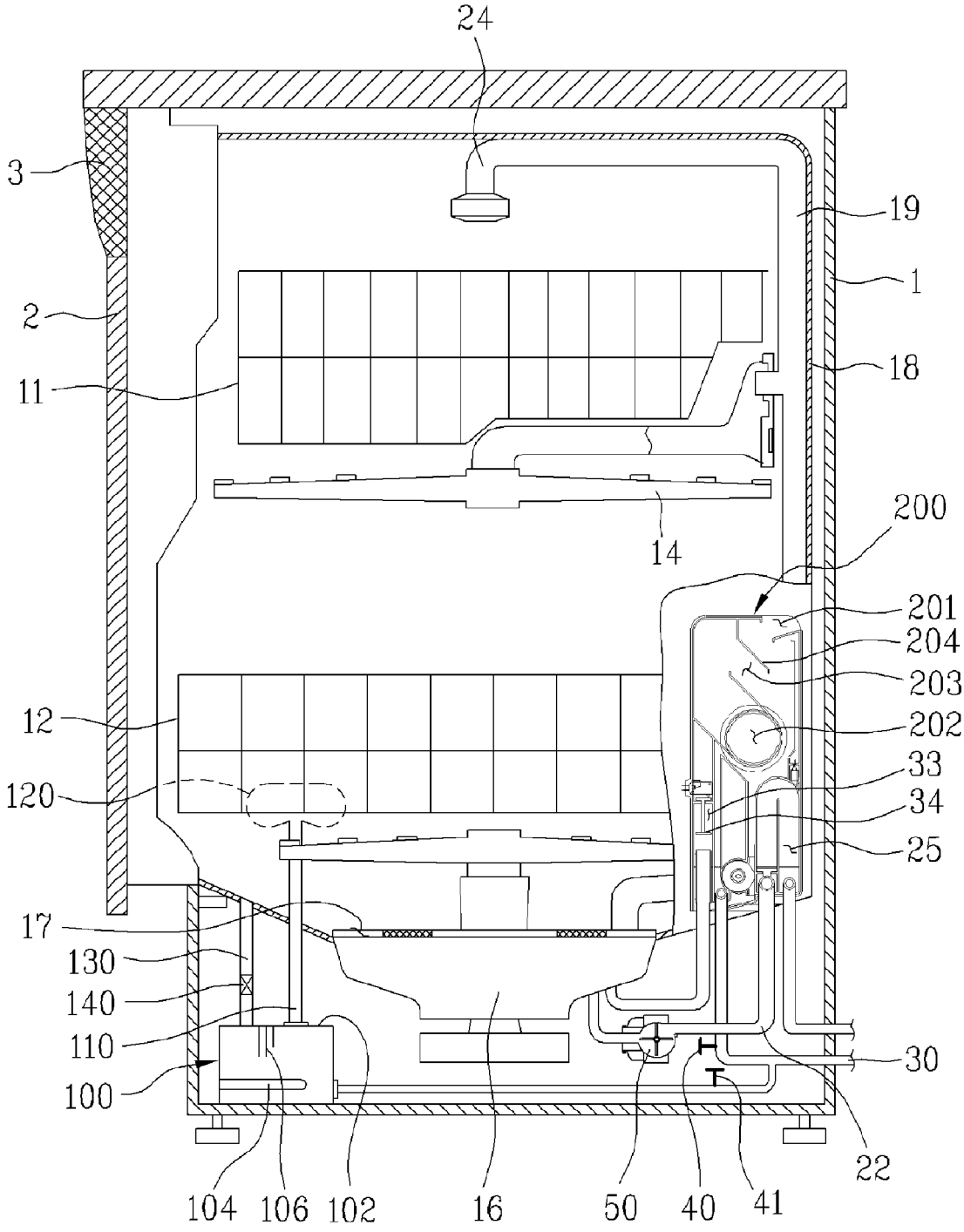
FIG. 2 shows a longitudinal section of the dish washer of FIG. 1.

FIG. 2 shows a longitudinal section of the dish washer of FIG. 1.

To describe the internal structure of the dish washer with reference to FIG. 2, the dish washer includes a tub 18 mounted in the case 1 for defining a space where dishes are washed and a sump 16 mounted at the bottom of the tub 18 for collecting wash water to wash the dishes and filtering garbage out of the wash water such that the filtered water can be sprayed to the dishes again.

In the sump 16 is mounted a predetermined pump (not shown), such as an impeller, for pumping out the wash water stored in the sump 16. A heater (not shown) is also mounted in the sump 16 for heating the wash water stored in the sump 16. Consequently, detergent may be easily dissolved in the wash water, and food waste on the dishes may be easily soaked by the heated wash water, thereby improving washing efficiency.

In the tub 18 are mounted racks in which dishes are received. In this embodiment, the racks include an upper rack 11 and a lower rack 12. However, the racks may be configured in various manners depending upon the size and capacity of the dish washer.

In the tub 18 are also mounted spray arms 14 and 15 for spraying wash water toward the upper rack 11 and the lower rack 12 and a spray arm 24 for spraying wash water from the upper part to the lower part of the tub 18. In the tub 18, at one side thereof, may be provided a wash water tube 19 for supplying the wash water stored in the sump 16 to the spray arms 14 and 24, located at the upper part of the tub 18, by the predetermined pump (not shown), such as the impeller.

Also, an introduction hole 17 may be formed at the bottom of the tub 18, i.e., at the top of the sump 16. Consequently, the wash water containing garbage, used to wash dishes, falls to the bottom of the tub 18, and is then collected into the sump 16 through the introduction hole 17. The wash water collected in the sump 16 may be supplied again to the spray arms 14, 15, and 24 by the predetermined pump, such as the impeller. At this time, the sump 16 may be constructed in a structure to filter the garbage from the wash water.

Meanwhile, the dish washer may further include a steam generator 100 for heating water received in the steam generator 100 to generate steam to be supplied into the tub 18, a steam tube 110 for guiding the steam generated by the steam generator 100 such that the steam is supplied into the tub 18, and at least one nozzle 120 for spraying the steam supplied from the steam tube 110 into the tub 18.

The steam generator 100 is located below the tub 18. As a result, the steam generated by the steam generator 100 can be smoothly supplied into the tub 18. This is because steam is lighter than air, and therefore, the steam exhibits a rising property. In the dish washer, however, the location of the steam generator 100 is not particularly restricted. Example, the steam generator 100 may be located at the side of the tub 18.

Specifically, the steam generator 100 includes a case 102 for receiving water, a heater 104 for heating the water received in the case 102, a water level sensor 106 for sensing the level of the water received in the case 102, and a fuse (not shown) for preventing the overheating of the heater 104.

The water level sensor 106 senses a low water level and a high water level. The low water level is set to prevent the overheating of the heater 104 in the steam generator 100, thereby securing the safety of the dish washer. The low water level is set to be higher than the installation position of the heater 104. On the other hand, the high water level is set to prevent the water supplied into the steam generator 100 from overflowing the steam generator 100. Consequently, when the high water level is sensed by the water level sensor 106 during the supply of water into the case 102, the supply of water is interrupted. On the other hand, when the lower water level is sensed by the water level sensor 106 during the generation of steam by the heater 104, the operation of the heater 104 is stopped, and water is supplied into the case 102.

Meanwhile, the dish washer may further include an air guide 200 mounted between the case 1 and the tub 18, i.e., at the outside of the tub 18, for achieving the communication between external air and the air in the tub 18.

Consequently, an atmospheric state is maintained in the tub 18 through the air guide 200, and therefore, it is possible to prevent the internal pressure of the tub 18 from rising due to steam or high-temperature air. This is to prevent breakage of the tub 18, which may occur when the internal pressure of the tub 18 rises, and, to prevent a user from being injured due to high internal pressure of the tub 18 when the user opens the door 2 during the operation of the dish washer.

Specifically, the air guide 200 includes an air suction port 201 for suctioning external air, an opening 202 for achieving the communication between the tub 18 and the air guide 200, and an air tube 203 for achieving the communication between the air suction port 201 and the opening 202.

Noise in the tub 18 is easily transmitted to the outside through the air suction port 201 via the opening 202. Such leakage of noise may be prevented by the provision of a baffle mounted at a predetermined position of the air tube 203. That is, the direction of the air tube 203 is changed at least once by the baffle 204, with the result that it is possible to effectively prevent the leakage of the noise in the tub 18 to the outside.

Meanwhile, the air guide 200 may further include a water supply tube 33 and a drainage tube 25, which are separated from the air tube 203. That is, water supplied from an external water source, such as a faucet, is supplied into the sump 16 through the water supply tube 33 provided in the air guide 200, and the water discharged from the sump 16 is drained to the outside through the drainage tube 25 provided in the air guide 200.

At this time, a water supply pipe 30 connected between the water supply tube 33 and the external water source branches into the water supply tube 33 and the steam generator 100 such that water can be supplied to the steam generator 100 as well as to the water supply tube 33. At predetermined position of the water supply pipe 30 are mounted a first valve 40 for controlling the amount of water supplied to the water supply tube 33 and a second valve 41 for controlling the amount of water supplied to the steam generator 100.

Consequently, when the first valve 40 is opened, water from the external water source is supplied into the sump 16 through the water supply tube 33. On the other hand, when the second valve 41 is opened, water from the external water source is supplied into the steam generator 110.

In the water supply tube 33 may be also mounted a water level sensor 34, by which an appropriate amount of wash water is introduced into the dish washer to prevent excessive supply of water.

At a predetermined position of a connection pipe 22 connected between the drainage tube 25 and the sump 16 is mounted a drainage pump 50. Consequently, the wash water in the sump 16 is drained to the outside through the drainage tube 25 by the operation of the drainage pump 50.

The discharge tube 25 is formed in a reverse U shape. Also, the discharge tube 25 extends through a position higher than the water level in the sump 16. This is because, if the drainage tube 25 is located lower than the sump 16, wash water newly supplied into the sump 16 may be drained through the drainage tube 25 due to the height difference between the drainage pump 25 and the sump 16 and the pressure difference caused by the height difference, even after the operation of the drainage pump 50.

This embodiment is constructed in a structure in which water from the external water source is supplied into the sump 16 through the water supply tube 33 of the air guide 200, and the wash water in the sump 16 is drained to the outside through the drainage tube 25 of the air guide 200, to which, however, the present invention is not limited. For example, water from the external water source may be directly supplied into the sump 16 not through the air guide 200, or the water in the sump 16 may be drained directly to the outside.

Hereinafter, the operation of the dish washer will be described briefly with reference to FIGS. 1 and 2.

First, when dishwashing is required, a user puts dishes into the racks 11 and 12, and closes the door 2.

Subsequently, the user manipulates the input device to make a desired operation of the dish washer to be performed. As a result, the operation of the dish washer is performed while the operation state of the dish washer is displayed on the display device 8.

To describe the operation of the dish washer according to the flow sequence of the wash water flowing in the tub 18, on the other hand, the wash water, sprayed from the spray arms 14, 15, and 24, washes the dishes placed in the racks 11 and 12, falls downward, and is collected into the sump 16 through the introduction hole 17.

In the sump 16 is mounted a predetermined pump, such as an impeller. The pump pumps out the wash water such that the wash water is resupplied to the respective spray arms 14, 15, and 24.

Also, the dish washer may carry out a washing process using steam according to a user's selection. To carry out the washing process using steam, steam generated by the steam generator 100 is supplied into the tub 18 through the steam tube 110 and the nozzle 120.

In the dish washer, therefore, it is possible to expect the improvement of washing efficiency of the dish washer which can be further obtained by high-temperature and high-humidity properties of the steam. For example, when the dishes are washed using the steam and the wash water, food waste fixed to the dishes is soaked by the steam, and the food waste is easily removed from the dishes by the high-pressure wash water.

Meanwhile, the waste separated from the dishes during the dishwashing using the steam may be introduced into the nozzle 120 and the steam tube 110, with the result that the nozzle 120 and the steam tub 110 may be clogged. When the nozzle 120 and the steam tub 110 are clogged by the garbage introduced into the nozzle 120 and the steam tube 110, the steam, generated by the steam generator 110, is not discharged from the steam generator 110, with the result that the internal pressure of the steam generator 100 increases, whereby the steam generator 100 may break or explode.

For this reason, it is preferable to prevent the internal pressure of the steam generator 100 from excessively rising at the time when the nozzle 120 or the steam tub 110 is clogged.

To this end, the dish washer may further include an auxiliary tube 130 for preventing the internal pressure of the steam generator 100 from exceeding a predetermined pressure when the steam tube 110 is clogged. Here, the predetermined pressure may be a maximum pressure at which the steam generator 100 does not break or explode.

The steam generated by the steam generator 100 or the water stored in the steam generator 100 is discharged out of the steam generator 100 through the auxiliary tube 130, whereby it is possible to prevent the internal pressure of the steam generator 100 from exceeding the predetermined pressure. That is, when the steam tube 110 is clogged, the steam generated by the steam generator 100 is discharged out of the steam generator 100 through the auxiliary tube 130, with the result that the internal pressure of the steam generator 100 does not rise. Alternatively, when the steam tube 110 is clogged, the water stored in the steam generator 100 is discharged out of the steam generator 100 through the auxiliary tube 130 due to the rising pressure, with the result that the internal pressure of the steam generator 100 does not rise.

On the other hand, the auxiliary tube 130 may be provided to discharge the steam generated by the steam generator 100 or the water stored in the steam generator 100 out of the dish washer. Consequently, when the steam tube 110 is clogged, the steam generated by the steam generator 100 or the water stored in the steam generator 100 may be discharged out of the dish washer through the auxiliary tube 130. In this case, it is possible for a user to recognize the clogging of the steam tube 110 from the steam or the water discharged out of the dish washer and to take a measure to solve the clogging of the steam tube 110.

As shown in FIG. 2, the auxiliary tube 130 is configured to discharge the steam generated by the steam generator 100 or the water stored in the steam generator 100 into the tub 18. For example, one side of the auxiliary tube 130 is connected to the steam generator 100, and the other side of the auxiliary tube 130 is connected to a predetermined position of the tub 18.

In a case in which the auxiliary tube 130 is configured to discharge the steam generated by the steam generator 100 into the tub 18 when the steam tube 110 is clogged, as described above, it is possible to prevent the internal pressure of the steam generator 100 from rising, and, in addition, to smoothly carry out the dishwashing process using the steam. Generally, the steam is generated at the time when the steam is needed during the dishwashing process of the dish washer. This is because, when the steam generated by the steam generator 100 is discharged into the tub 18 although the steam tube 110 is clogged, it is possible to smoothly carry out the dishwashing process using the steam. Of course, the discharge of the steam into the tub 18 has the effect of reducing the waste of resources as compared with the drainage of the steam to the outside.

Also, in a case in which the auxiliary tube 130 is configured to discharge the water stored in the steam generator 100 into the tub 18 when the steam tube 110 is clogged, the water discharged into the tub 18 may be drained to the outside through the drainage tube 25 of the dish washer, which is preferred.

Meanwhile, it is preferred to discharge the steam into the tub 18 through the auxiliary tube 130 only when the steam tube 110 is clogged. This is because, when the steam tube 110 is not clogged, it is preferred to supply the steam into the tub 18 through the steam tube 110.

To this end, the dish washer may include a sensor (not shown) for sensing whether the steam tube 110 is clogged or not, a valve 140 mounted at a predetermined position of the auxiliary tube 130 for selectively opening and closing the auxiliary tube 130, and a controller (not show) for controlling the valve 140 to be opened when the clogging of the steam tube 110 is sensed by the sensor.

Consequently, since the auxiliary tube 130 is closed by the valve 140 when the steam tube 110 is not clogged, the steam generated by the steam generator 100 can be supplied into the tub 18 only through the steam tube 110. On the other hand, when the steam tube 110 is clogged, the valve 140 is opened by controller, and therefore, the steam generated by the steam generator 100 is discharged into the tub 18 through the auxiliary tube 130.

Since the steam tube 110 is clogged when the internal pressure of the steam generator 100 rises, the water stored in the steam generator 100 may also discharged into the tub 18 through the auxiliary tube 130 when the valve 140 is opened by the controller.

The kind of the sensor is not particularly restricted as long as the sensor can sense whether the steam tube 110 is clogged or not. For example, the sensor may be a heat sensor and may be mounted at the end of the steam tube 110. In this case, the sensor can sense whether the steam tube 110 is clogged or not by sensing whether steam is discharged through the steam tube 110. When the steam is discharged through the steam tube 110, the heat sensor can sense heat from the steam; however, when the steam is not discharged, the heat sensor cannot sense heat.

The sensor is a pressure sensor for sensing the internal pressure of the steam generator 100. When the steam tube 110 is clogged, with the result that the steam generated by the steam generator 100 cannot be discharged into the tub 18, the internal pressure of the steam generator 100 greatly rises. At this time, the pressure sensor can sense whether the steam tube 110 is clogged or not by sensing the internal pressure of the steam generator 100.

When the pressure sensed by the pressure sensor exceeds a predetermined pressure, the controller determines that the steam tube 110 is clogged and controls the valve 140 to be opened such that the steam is discharged into the tub 18 through the auxiliary tube 130.

Here, the predetermined pressure is a pressure indicating that the steam tube 110 is clogged. The internal pressure of the steam generator 100 may vary. Therefore, the predetermined pressure indicates that the internal pressure of the steam generator 100 rises to such an extent that it is recognized that the steam tube 110 is clogged.

Figure 3:
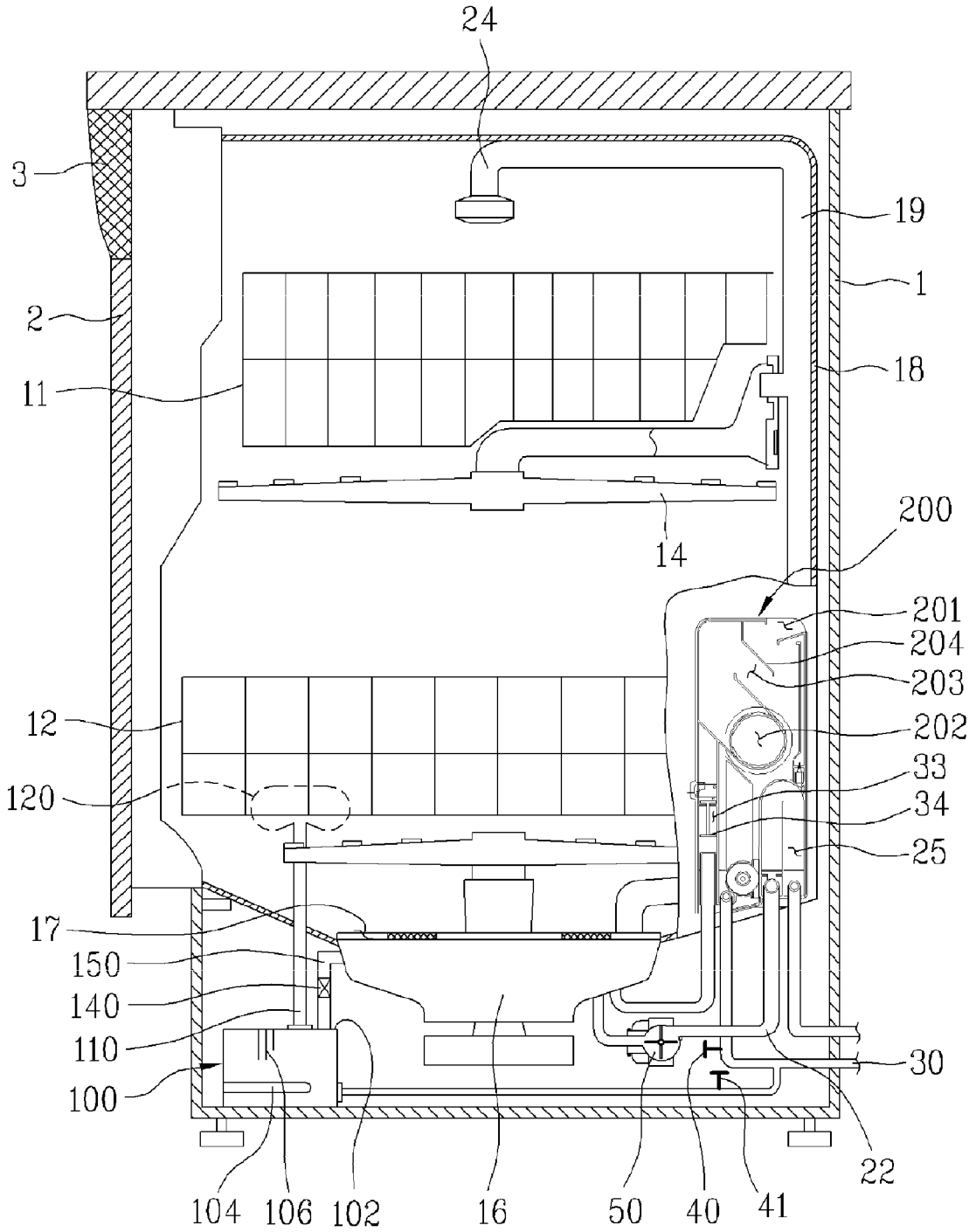
FIG. 3 shows a second embodiment of a dish washer according to the present invention.

FIG. 3 is a longitudinal sectional view showing a second embodiment of a dish washer.

This embodiment is identical to the previous embodiment except an auxiliary tube 150. Therefore, components of this embodiment identical to those of the previous embodiment are denoted by the same reference numerals, and a detailed description thereof will not be given.

Referring to FIG. 3, the auxiliary tube 150 according to this embodiment may be configured to discharge steam generated by the steam generator 100 or water stored in the steam generator 100 into the tub 18 through the sump 16 when the steam tube 110 is clogged. For example, one side of the auxiliary tube 150 may be connected to a predetermined position of the steam generator 100, and the other side of the auxiliary tube 150 may be connected to a predetermined position of the sump 16.

Since the sump 16 is configured to receive wash water and supply the wash water into the tub 18, the steam generated by the steam generator 100 or the water stored in the steam generator 100 may be discharge into the sump 16 through the auxiliary tube 150 and then supplied into the tub 18.

In this embodiment, the sensor, the valve 140, and the controller may be provided to discharge the steam generated by the steam generator 100 into the tub 18 through the auxiliary tube 150 only when the steam tube 110 is clogged, as in the previous embodiment shown in FIG. 2.

Meanwhile, the other end of the auxiliary tube 150 is connected to a position of the sump 16 higher than the water level of the wash water received in the sump 16. This is because, when the other end of the auxiliary tube 150 is connected to a position of the sump 16 lower than the water level of the wash water received in the sump 16, the wash water may be introduced into the auxiliary tube 150.

As shown in FIG. 3, the other end of the auxiliary tube 150 is connected to a position adjacent to the introduction hole 17, formed at one side of the top of the sump 16. In this case, the steam discharged through the auxiliary tube 150 may be supplied directly into the tub 18 through the introduction hole 17.

Figure 4:
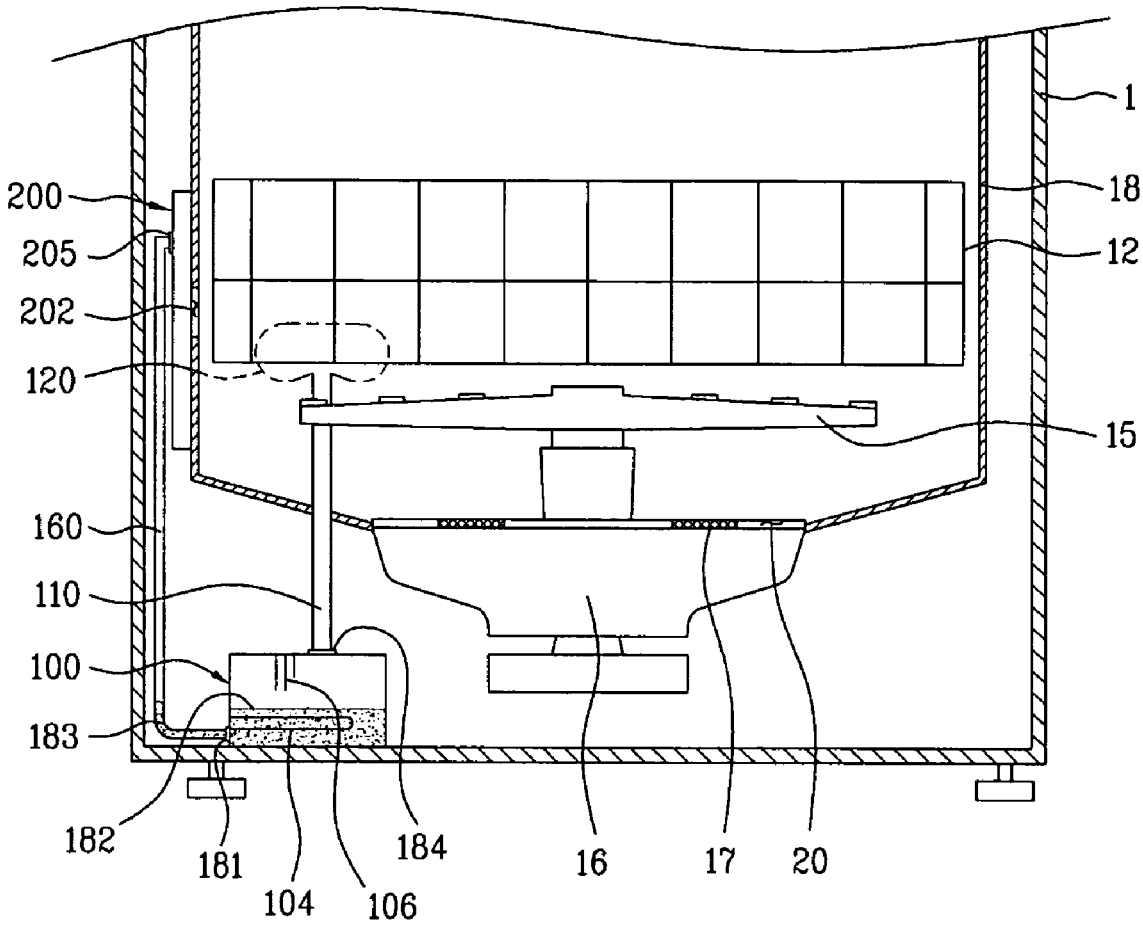
FIG. 4 shows a third embodiment of a dish washer according to the present invention.

FIG. 4 is a longitudinal sectional view schematically showing a third embodiment of a dish washer.

This embodiment is identical to the previous embodiment shown in FIG. 2 except an auxiliary tube 160. Therefore, components of this embodiment identical to those of the previous embodiment are denoted by the same reference numerals, and a detailed description thereof will not be given.

Referring to FIG. 4, the auxiliary tube 160 according to this embodiment may be configured to discharge steam generated by the steam generator 100 or water stored in the steam generator 100 into the tub 18 through the air guide 200 when the steam tube 110 is clogged. For example, one side of the auxiliary tube 150 may be connected to a predetermined position of the steam generator 100, and the other side of the auxiliary tube 150 may be connected to a predetermined position of the air guide 200.

Since the air guide 200 is mounted between the case 1 and the tub 18, i.e., at the outside of the tub 18, for achieving the communication between external air and the air in the tub 18, the steam generated by the steam generator 100 or the water stored in the steam generator 100 may be discharge into the air guide 200 through the auxiliary tube 160 and then supplied into the tub 18.

It is possible to easily manufacture the dish washer when the auxiliary tube 160 is connected to the air guide 200 than when the auxiliary tube 160 is connected to the tub 18 and the sump 16. This is because the air guide 200 is manufactured as a module, which is attached to the outside of the tub 18, and therefore, a first connection part 205, to which the auxiliary tube 160 is connected, is easily formed at a predetermined position of the air guide 200.

Also, the tub 18 and the sump 16 are spaces in which wash water flows, and therefore, there is a possibility that the wash water is introduced into the auxiliary tube 160. However, the air guide 200 is a space in which air flows, and therefore, there is no possibility that the wash water is introduced into the auxiliary tube 160, which is preferred.

Specifically, the air guide 200 includes the air suction port 201, the opening 202, and the air tube 203. The first connection part 205 may be located at a position adjacent to any one of the air suction port 201, the opening 202, and the air tube 203. The first connection part 205 is located at a position adjacent to the opening 202. In this case, the steam, discharged into the air guide 200 through the auxiliary tube 160, may be supplied directly into the tub through the opening 202.

In this embodiment, the sensor, the valve, and the controller may be provided to discharge the steam generated by the steam generator 100 into the tub 18 through the auxiliary tube 160 only when the steam tube 110 is clogged, as in the previous embodiment shown in FIG. 2.

On the other hand, a second connection part 181, connected between the auxiliary tube 160 and the steam generator 100, may be mounted at the bottom of the steam generator 100. Consequently, it is possible to discharge the steam or the water into the tub 18 through the auxiliary tube 160 only when the steam tube 110 is clogged, without the provision of the sensor, the valve, and the controller. This is because steam exhibits a rising property.

In this case, a third connection part 184, connected between the steam tube 110 and the steam generator 100, may be located at a position higher than the second connection part 181. That is, it is preferred for the second connection part 181 to be located at a position lower than the third connection part 184. Consequently, when the steam tube 110 is not clogged, the steam generated by the steam generator 100 is supplied into the tub 18 through the steam tube 110, and, when the steam tube 110 is clogged, the steam generated by the steam generator 100 is supplied into the tub 18 through the auxiliary tube 160.

The second connection part 181 is located at a position lower than the low water level of the steam generator 100. In this case, an introduction part 183 of the auxiliary tube 160 is filled with water to a water level 182 corresponding to the water level of the steam generator 100. Consequently, when the steam tube 110 is not clogged, the steam generated by the steam generator 100 or the water stored in the steam generator 100 is not discharged to the auxiliary tube 160. On the other hand, when the steam tube 110 is clogged, the internal pressure of the steam generator 100 increases, and therefore, the steam or the water is discharged through the introduction part 183 of the auxiliary tube 160.

That is, when the steam tube 110 is not clogged, the steam generated by the steam generator 100 is discharged only through the steam tube 110, and, when the steam tube 110 is clogged, the steam generated by the steam generator 100 is discharged through the auxiliary tube 160.

The air guide 200 is located at a position higher than the steam generator 100. Consequently, when the internal pressure of the steam generator 100 does not exceed a predetermined pressure, the water stored in the steam generator 100 is not discharged into the tub 18 through the auxiliary tube 160, and, only when the internal pressure of the steam generator 100 exceeds the predetermined pressure, the water is discharged into the tub 18 through the auxiliary tube 160.

Therefore, the simple structure as described above has the same effect as the structure including the sensor, the valve, and the controller as shown in FIG. 2.

Meanwhile, the above-described structure is also applicable to the embodiments shown in FIGS. 2 and 3, i.e., the structure in which the auxiliary tube is connected to the sump 16 or the tub 18.

As apparent from the above description, the idea of the present invention is to prevent the internal pressure of the steam generator from increasing when the steam tube is clogged. However, the idea of the present invention is not limited to the embodiments previously described. That is, it will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

For example, the dish washer may include a sensor for sensing the clogging of the steam tube and a controller for stopping the operation of the steam generator when the clogging of the steam tube is sensed by the sensor.

This is to stop the operation of the steam generator, such that no more steam is generated by the steam generator, thereby preventing the internal pressure of the steam generator from increasing, unlike the previously described method of discharging the steam generated by the steam generator, when the steam tube is clogged, thereby preventing the internal pressure of the steam generator from increasing.

The sensor may be a pressure sensor for sensing the internal pressure of the steam generator, and the controller may control the steam generator to be stopped when the pressure sensed by the pressure sensor exceeds a predetermined pressure. More specifically, when the pressure sensed by the pressure sensor exceeds the predetermined pressure, the controller determines that the steam tube is clogged and controls the heater in the steam generator to be turned off such that no more steam is generated by the steam generator.

What is claimed is:

1. A dish washer comprising:

a tub to provide a room for dishes for washing;

a sump to hold water for supplying to the tub for the washing;

a steam generator to generate steam;

a first tube connected to the steam generator to supply the steam to the tub; and a second tube connected to the steam generator and configured to allow the steam or water inside the steam generator to be discharged into a room of the tub according to a pressure inside the steam generator during generating the steam, wherein the second tube is connected to a lower portion of the steam generator.

2. The dish washer of the claim 1, wherein the second tube is connected to the tub.

3. The dish washer of the claim 1, further comprising an air guide to allow outside air to flow into the tub, wherein the second tube is connected to the air guide.

4. The dish washer of the claim 1, wherein the second tube is connected to a portion lower than a water level sensor of the steam generator.

5. The dish washer of the claim 1, wherein the second tube is connected to the steam generator at a portion lower than where the first tube is connected.

* * * * *